US006741119B1

(12) United States Patent
Aude et al.

(10) Patent No.: US 6,741,119 B1
(45) Date of Patent: May 25, 2004

(54) BIASING CIRCUITRY FOR GENERATING BIAS CURRENT INSENSITIVE TO PROCESS, TEMPERATURE AND SUPPLY VOLTAGE VARIATIONS

(75) Inventors: Arlo Aude, Atlanta, GA (US); Vikram Krishanmurthy, Atlanta, GA (US); Muhammad Shakeel Qureshi, Atlanta, GA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/231,811

(22) Filed: Aug. 29, 2002

(51) Int. Cl.[7] ..... G05F 1/10; G05F 3/02

(52) U.S. Cl. ..... 327/543; 327/539; 323/315

(58) Field of Search ..... 327/538–541, 327/543; 323/312, 313, 315, 316; 330/288, 289, 296

(56) References Cited

U.S. PATENT DOCUMENTS 4,605,892 A * 8/1986 Seevinck et al. ..... 323/315
5,164,658 A * 11/1992 Kuwahara ..... 323/315
5,963,082 A * 10/1999 Dick et al. ..... 327/538

OTHER PUBLICATIONS

Pusl et al., Power Amplifier ICs with SWR Protection for Handset Applications, Microwave Journal, 2001, pp. 1–10.

* cited by examiner

*Primary Examiner*—Terry D. Cunningham
*Assistant Examiner*—Quan Tra
(74) *Attorney, Agent, or Firm*—Vedder, Price, Kaufman & Kammholz, P.C.

(57) ABSTRACT

Biasing circuitry for generating and maintaining a substantially constant output bias current. Ratios of selected bias currents and selected transistor sizes ensure that a nominal load current is maintained notwithstanding variations in circuit fabrication processes, power supply voltage and operating temperature.

18 Claims, 1 Drawing Sheet

BIASING CIRCUITRY FOR GENERATING BIAS CURRENT INSENSITIVE TO PROCESS, TEMPERATURE AND SUPPLY VOLTAGE VARIATIONS

BACKGROUND OF THE INVENTION

1. Field of the Invention

The present invention relates to biasing circuitry for generating stable biasing signals and in particular, to biasing circuitry for generating and maintaining substantially constant output bias currents notwithstanding variations in circuit fabrication processes, power supply voltage, and operating temperature.

2. Description of the Related Art

Amplifier operating efficiency is important in virtually all circuit applications. However, this is particularly true for power amplifiers in radio frequency (RF) circuit applications, especially for mobile devices. In many such applications, particularly for mobile devices, such circuitry will often be required to operate over variations in temperature and power supply voltages. Further, variations in the fabrication or other manufacturing processes in producing such circuitry can also induce undesirable variations in operating characteristics.

SUMMARY OF THE INVENTION

Biasing circuitry in accordance with the presently claimed invention generates and maintains a substantially constant output bias current. Ratios of selected bias currents and selected transistor sizes ensure that a nominal, or average, load current is maintained notwithstanding variations in circuit fabrication processes, power supply voltage and operating temperature.

In accordance with one embodiment of the presently claimed invention, biasing circuitry for generating and maintaining a substantially constant output bias current notwithstanding variations in circuit fabrication processes, power supply voltage and operating temperature includes first current replication circuitry, second current replication circuitry and a reference transistor. The fast current replication circuitry receives a reference current having a magnitude Iref and in response thereto generates a bias signal and a first replica current having a magnitude N*Iref. The second current replication circuitry, coupled to the first current replication circuitry, receives the bias signal and in response thereto generates a branch current having a magnitude Ib and a second replica current having a magnitude M*Ib. The reference transistor, coupled to the first and second current replication circuitry, receives the branch current as an input current and conducts the first replica current as an output current.

In accordance with another embodiment of the presently claimed invention, biasing circuitry for generating and maintaining a substantially constant output bias current notwithstanding variations in circuit fabrication processes, power supply voltage and operating temperature includes first current replicator means, second current replicator means and reference transistor means. The first current replicator means is for receiving a reference current having a magnitude Iref and in response thereto generating a bias signal and a first replica current having a magnitude N*Iref. The second current replicator means is for receiving the bias signal and in response thereto generating a branch current having a magnitude Ib and a second replica current having a magnitude M*Ib. The reference transistor means is for receiving the branch current as an input current and conducting the first replica current as an output current.

BRIEF DESCRIPTION OF THE DRAWINGS

The FIGURE illustrates a schematic diagram of biasing circuitry in accordance with one embodiment of the presently claimed invention providing a consistent bias current for a power amplifier circuit.

DETAILED DESCRIPTION OF THE INVENTION

Figure 1:
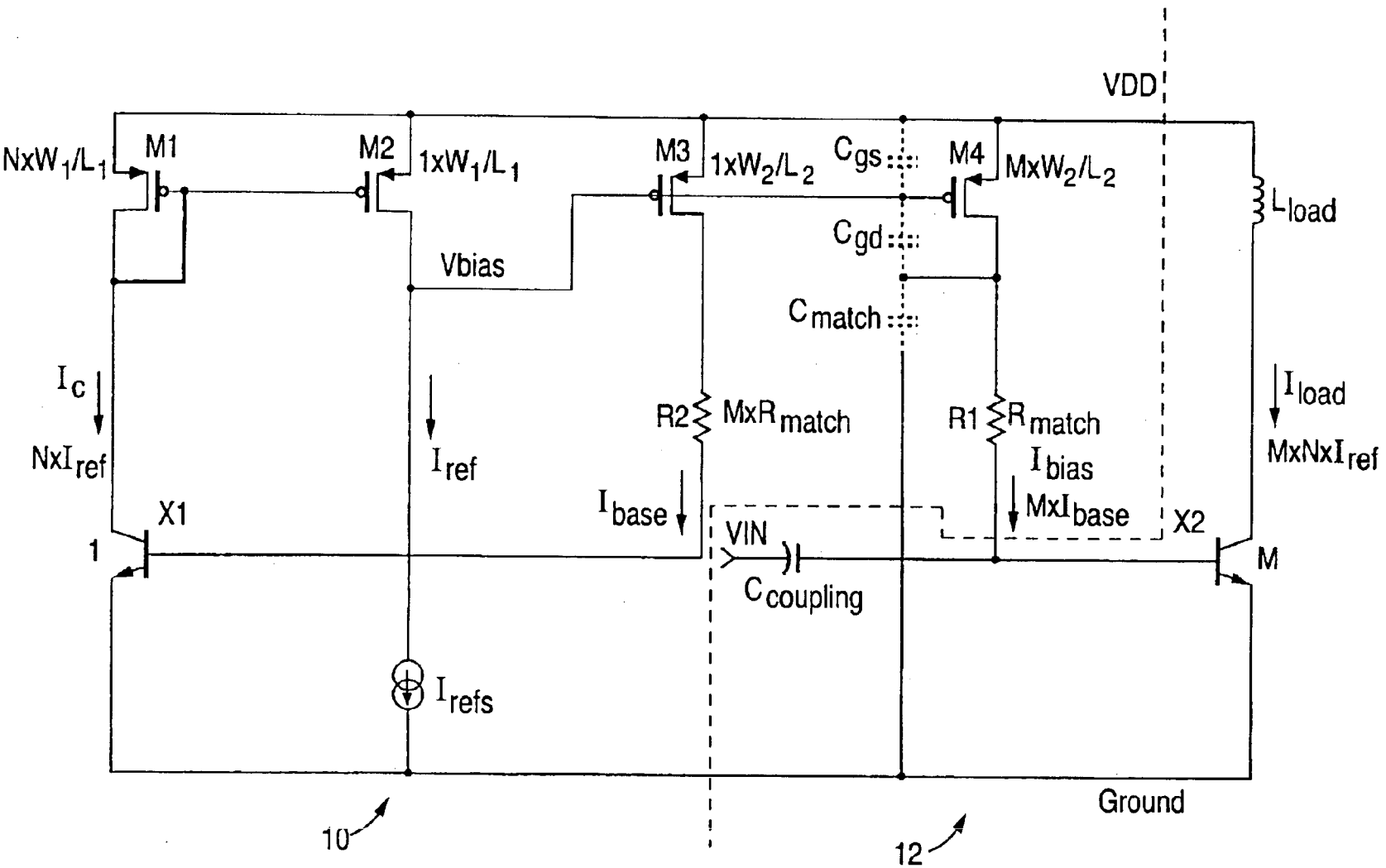

The following detailed description is of example embodiments of the presently claimed invention with references to the accompanying drawings. Such description is intended to be illustrative and not limiting with respect to the scope of the present invention. Such embodiments are described in sufficient detail to enable one of ordinary skill in the art to practice the subject invention, and it will be understood that other embodiments may be practiced with some variations without departing from the spirit or scope of the subject invention.

Throughout the present disclosure, absent a clear indication to the contrary from the context, it will be understood that individual circuit elements as described may be singular or plural in number. For example, the terms "circuit" and "circuitry" may include either a single component or a plurality of components, which are either active and/or passive and are connected or otherwise coupled together to provide the described function. Additionally, the term "signal" may refer to one or more currents, one or more voltages, or a data signal. Within the drawings, like or related elements will have like or related alpha, numeric or alphanumeric designators.

Referring to the FIGURE, one embodiment 10 of biasing circuitry in accordance with the presently claimed invention provides a substantially constant output bias current Ibias for use by power amplifier circuitry 12 to maintain a substantially constant nominal, or average, load current Iload. This biasing circuitry 10 includes current replication circuitry formed by P-type metal oxide semiconductor field effect transistors (P-MOSFETs) M1 and M2, further current replication circuitry formed by P-MOSFETs M3 and M4, and a reference transistor in the form of bipolar junction transistor (BJT) X1.

The first current replication circuitry M1, M2 is a classic current mirror circuit that uses an input reference current Iref provided by a reference current source Irefs which can be produced by using a conventional stable reference signal source (e.g., a bandgap voltage reference as is well known in the art). This input reference current Iref is replicated by transistors M1 and M2 to produce a replica current Ic at the drain terminal of transistor M1. The channel of transistor M1 has a width-to-length ratio N*W1/L1 that is N-times that W1/L1 of transistor M2. Accordingly, the replica current Ic produced by transistor M1 is N-times the magnitude of the reference current Iref, or Ic=N*Iref.

The direct connection of the drain and gate terminals of transistor M1 (which is diode-connected) forms a circuit node having a relatively low impedance (at signal frequencies due to the gate-to-source junction of transistor M1 between such connection and signal ground at the power supply terminal VDD), thereby introducing a high frequency pole in the overall circuit transfer function. Conversely, the high impedance node formed at the connection between the drain terminal of transistor M2 and the reference current source Irefs introduces a low frequency pole. Compensation (with respect to gain and phase margins) for this high impedance node is provided by the inherent gate-to-source capacitance Cgs of transistors M3 and M4 (discussed in more detail below).

With conduction by transistor M2 of the reference current Iref, a bias voltage Vbias is produced at the drain terminal of transistor M2. This bias voltage Vbias drives the commonly connected gate terminals of P-MOSFETs M3 and M4. Transistor M4 has a channel with a width-to-length ratio M*W2/L2 that is M-times that W2/L2 of transistor M3. With this commonly applied bias voltage Vbias at their gate terminals, transistors M3 and M4 produce drain currents Ibase and Ibias, respectively, having magnitudes with a ratio of Ibase:Ibias=1:M.

The current Ibase produced by transistor M3 provides the necessary base current for the reference transistor X1. The drain current Ibias produced by transistor M4 provides the base current for the output transistor X2 in the output amplifier circuitry 12. This output transistor X2, also a BJT, is M-times as large as the reference transistor X1 (preferably formed by connecting M transistors in parallel, each of which is equal in size and manufacturing method(s) to the reference transistor X1). Accordingly, due to the ratio N between transistors M1 and M2 and the ratio M between transistors M4 and M3, the load current Iload produced by the output transistor X2 is M*N times as large as the reference current Iref, or Iload=M*N*Iref.

The input RF signal VIN is applied to the base of the output transistor X2 through a series coupling capacitor Ccoupling. The load circuitry, represented by an inductive circuit element Lload, is connected to the power supply terminal VDD and is driven by the load current Iload via the collector terminal of transistor X2.

At the RF frequencies of the input signal VIN, the inherent gate-to-drain Cgd and gate-to-source Cgs capacitances of transistor M4 begin to decline in impedance and approach a short circuit between the drain terminal of transistor M4 and circuit signal ground at the power supply terminal VDD. To prevent the base terminal of transistor X2 from thereby also becoming shorted to circuit ground, a resistor R1 having a resistance value Rmatch is included to ensure a sufficient impedance is maintained between the input signal node at the base of transistor X2 and circuit signal ground at the power supply terminal VDD. The value Rmatch of this resistor R1 should be selected to properly terminate the base of the output transistor X2 at the frequency of interest for maximum operating efficiency (e.g., typically 50 ohms). As will be readily understood by one of ordinary skill in the art, the introduction of this resistive element R1 will also introduce a parasitic capacitance Cmatch which should be taken into account when tuning the value Rmatch of this resistance R1.

This parasitic capacitance Cmatch plays an important role in establishing immunity of circuit operation from variations in the power supply voltage VDD, often referred to as power supply rejection ration (PSRR). As noted above, at higher frequencies, the inherent gate-to-drain Cgd and gate-to-source Cgs capacitances of transistor M4 decline in impedance and can effectively short the drain terminal of transistor M4 to circuit signal ground at the power supply terminal VDD. This causes the base terminal of transistor X2 to become more closely coupled to the power supply terminal VDD via resistor R1 rather than being relatively isolated by the operation of transistor M4. In turn, this causes the PSRR to degrade since voltage variations, including noise, present on the power supply terminal VDD become more likely to be passed through and possibly amplified by the operation of transistor X2.

Accordingly, when introducing resistor R1 and, therefore, its parasitic capacitance Cmatch, such capacitance Cmatch should be designed (in accordance with well known techniques) to be sufficiently large so as to cause its impedance to predominate over the impedance of the effective capacitance of the series combination of the gate-to-drain Cgd and gate-to-source Cgs capacitances of transistor M4. With a sufficiently high value of capacitance Cmatch, high frequency signals, such as noise, arriving via the power supply terminal VDD will be more effectively shunted to circuit ground through such capacitance Cmatch rather than be passed through and possibly amplified by transistor X2, thereby maintaining a higher PSRR.

In a related manner, and to improve matching of drain currents Ibase and Ibias of transistors M3 and M4, respectively, another resistor R2 having a resistance value M*Rmatch can be included. This will ensure that equal voltage drops will appear across these resistors R1, R2, thereby ensuring that the base terminals of the reference X1 and output X2 transistors operate at equal voltages with respect to circuit ground.

Based upon the foregoing discussion, it can be seen that biasing circuitry in accordance with the presently claimed invention advantageously minimizes sensitivity to variations in circuit fabrication processes and operating temperature. For example, by maintaining a constant base current for the output transistor (e.g., as opposed to buffering its base-to-emitter bias voltage) and maintaining equal emitter voltages (both at circuit ground potential) and equal base voltages, the load current Iload is dependent virtually only on the selected ratios N, M for the various currents and transistor sizes. Such ratios are independent of and unaffected by variations in circuit or device fabrication processes as well as supply voltage and operating temperature. Accordingly, even though the collector voltages of the reference X1 and output X2 transistors may vary with power supply voltage VDD, as well as effects of variations in fabrication processes or operating temperature, the parameters of significance, i.e., the bias currents Iref, Ic, Iload will not be affected.

Various other modifications and alternations in the structure and method of operation of this invention will be apparent to those skilled in the art without departing from the scope and the spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including biasing circuitry for generating and maintaining a substantially constant output bias current notwithstanding variations in circuit fabrication processes, power supply voltage and operating temperature, comprising:

first current replication circuitry that receives a reference current having a magnitude Iref and in response thereto generates a bias signal, and a first replica current having a magnitude N*Iref;

second current replication circuitry, coupled to said first current replication circuitry, that receives said bias signal and in response thereto generates a branch current having a magnitude Ib, and
a second replica current having a magnitude M*Ib;

a reference transistor, coupled to said first and second current replication circuitry, that receives said branch current as an input current and conducts said first replica current as an output current; and output transistor circuitry, coupled to said second current replication circuitry, that receives said second replica current and in response thereto generates an output current having a magnitude M*N*Iref.

2. The apparatus of claim 1, wherein said first current replication circuitry comprises:

first circuit branch that conducts said reference current; and second circuit branch, coupled to said first circuit branch that provides said first replica current.

3. The apparatus of claim 2, wherein said second current replication circuitry comprises:

third circuit branch, coupled to said second circuit branch, that receives said bias signal and in response thereto generates said branch current; and fourth circuit branch, coupled to said first circuit branch, that receives said bias signal and in response thereto generates said second replica current.

4. The apparatus of claim 3, wherein:

said third circuit branch includes a first serially coupled circuit element having a resistance magnitude M*R; and said fourth circuit branch includes a second serially coupled circuit element having a resistance magnitude R.

5. The apparats of claim 1, wherein said first current replication circuitry comprises current mirror circuitry.

6. The apparatus of claim 1, wherein said second current replication circuitry comprises:

first circuit branch that receives said bias signal and in response thereto generates said branch current; and second circuit branch, coupled to said first circuit branch, that receives said bias signal and in response thereto generates said second replica current.

7. The apparatus of claim 6, wherein:

said first circuit branch includes a first serially coupled circuit element having a resistance magnitude M*R; and said second circuit branch includes a second serially coupled circuit element having a resistance magnitude R.

8. The apparats of claim 7, wherein said second current replication circuitry comprises a shunt capacitance coupled to said second circuit branch.

9. The apparatus of claim 1, wherein said second current replication circuitry comprises current mirror circuitry.

10. The apparatus of claim 1, wherein said output transistor circuitry comprises M transistors, wherein each one of said M transistors is substantially equal in size to said reference transistor.

11. An apparatus including biasing circuitry for generating and maintaining a substantially constant output bias current notwithstanding variations in circuit fabrication processes, power supply voltage and operating temperature, comprising:

first current replicator means for receiving a reference current having a magnitude Iref and in response thereto generating
a bias signal, and
a first replica current having a magnitude N*Iref;

second current replicator means for receiving said bias signal and in response thereto generating
a branch current having a magnitude Ib, and
a second replica current having a magnitude M*Ib; and reference transistor means for receiving said branch current as an input current and conducting said first replica current as an output current.

12. The apparatus of claim 11, wherein said current replicator means comprises:

first circuit means for conducting said reference current, and second circuit means for providing said first replica current.

13. The apparatus of claim 12, wherein said second current replicator means comprises:

third circuit means for receiving said bias signal and in response thereto generating said branch current; and fourth circuit means for receiving said bias signal and in response thereto generating said second replica current.

14. The apparatus of claim 13, wherein:

said third circuit means is further for providing a first series resistance having a magnitude M*R; and said fourth circuit means is further for providing a second series resistance having a magnitude R.

15. The apparatus of claim 11, wherein said second current replicator means comprises:

first circuit means for receiving said bias signal and in response thereto generating said branch current; and second circuit means for receiving said bias signal and in response thereto generating said second replica current.

16. The apparatus of claim 15, wherein:

said first circuit means is further for providing a first series resistance having a magnitude M*R; and said second circuit means is further for providing a second series resistance having a magnitude R.

17. The apparatus of claim 15, wherein said second current replicator means is further for providing a shunt capacitance for said second circuit means.

18. The apparatus of claim 11, further comprising output transistor means for receiving said second replica current and in response thereto generating an output current having a magnitude M*N*Iref.

* * * * *

UNITED STATES PATENT AND TRADEMARK OFFICE

CERTIFICATE OF CORRECTION

PATENT NO. : 6,741,119 B1
DATED : May 25, 2004
INVENTOR(S) : Aude et al.

It is certified that error appears in the above-identified patent and that said Letters Patent is hereby corrected as shown below:

Column 5,
Lines 33 and 50, please delete “apparats” and replace with -- apparatus --.

Column 6,
Line 19, after the word “said”, please add the word -- first --.

Signed and Sealed this

Eleventh Day of October , 2005

JON W. DUDAS
*Director of the United States Patent and Trademark Office*